US006039130A

United States Patent [19]

Pruet

[11] Patent Number: 6,039,130

[45] Date of Patent: Mar. 21, 2000

[54] SQUARE DRILL COLLAR FEATURING OFFSET MASS AND CUTTER

[76] Inventor: Glen Pruet, 2301 Christine, Pampa, Tex. 79065-3032

[21] Appl. No.: 09/035,215

[22] Filed: Mar. 5, 1998

[51] Int. Cl.[7] ..... E21B 17/00

[52] U.S. Cl. ..... 175/320; 175/325.1; 175/406

[58] Field of Search ..... 175/320, 406, 175/325.1, 325.5, 55, 91, 323; 166/173

[56] References Cited

U.S. PATENT DOCUMENTS

| | | | |
|---|---|---|---|
| 747,575 | 12/1903 | Baker | 175/399 |
| 3,231,033 | 1/1966 | Williams | 175/406 |
| 3,237,705 | 3/1966 | Williams | 175/406 |
| 5,328,304 | 7/1994 | Kress et al. | 408/83 |

FOREIGN PATENT DOCUMENTS

| | | | |
|---|---|---|---|
| 1283-380 | 1/1987 | U.S.S.R. | 175/320 |

OTHER PUBLICATIONS

Bingman, W.E., "Square Pegs in a Round Hole"; Mar. 19, 1962, Oil and Gas Journal pp177–181.

*Primary Examiner*—David Bagnell
*Assistant Examiner*—John Kreck
*Attorney, Agent, or Firm*—Gunn & Associates, P.C.

[57] ABSTRACT

This disclosure is directed to an improved drill collar having pin and box connection in an elongate hollow member. In cross-section, the drill collar is formed of a square billet defining three rectangular corners. The fourth corner is rounded thereby reducing the weight in that area and thereby creating an eccentered center of mass and mass moment of inertia. A cutter is located along one of the edges so that the cutter scuffs against the well borehole during rotation to thereby enhance circular configuration and to reduce key seating or deviation.

20 Claims, 1 Drawing Sheet

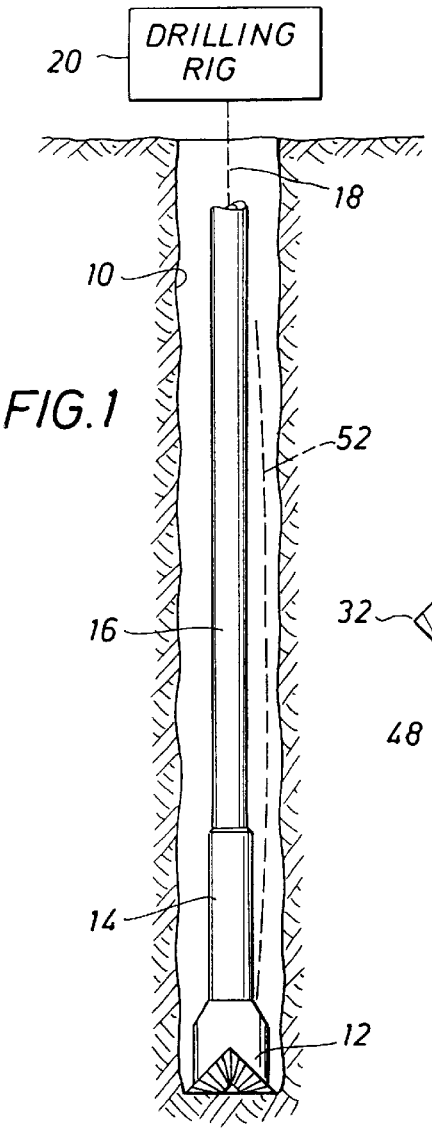
FIG. 1
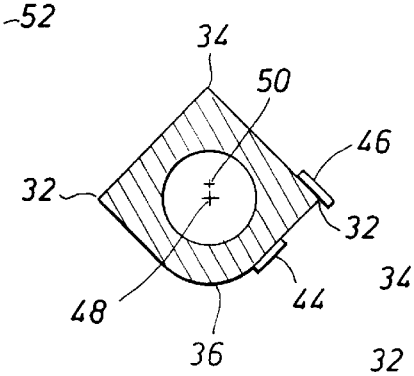
FIG. 3
FIG. 2
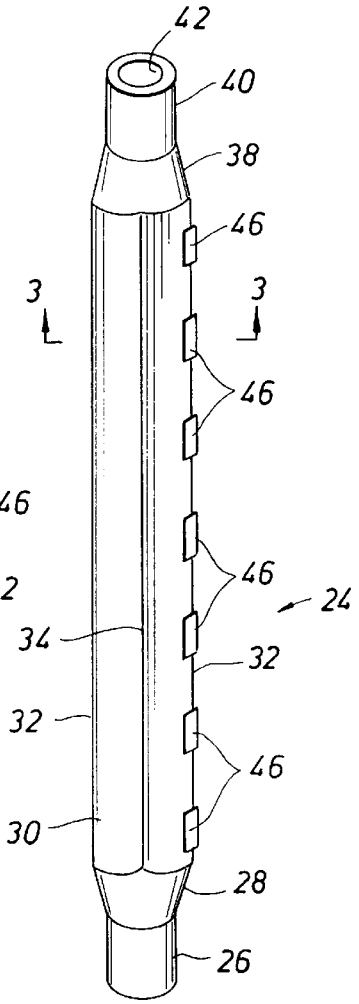
FIG. 4
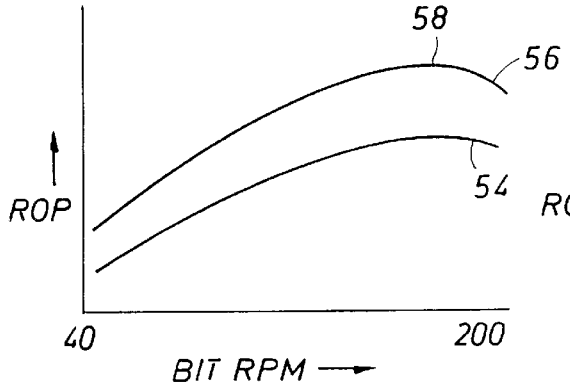
FIG. 5
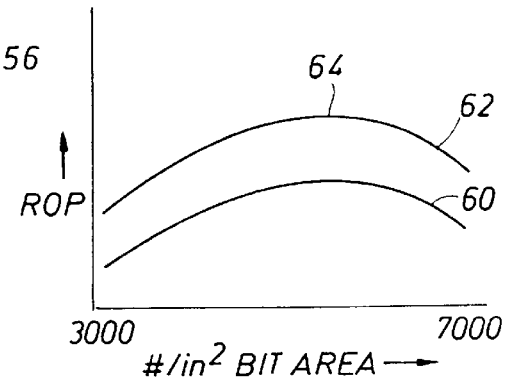

SQUARE DRILL COLLAR FEATURING OFFSET MASS AND CUTTER

BACKGROUND OF THE DISCLOSURE

In drilling a deep oil well, it is normally intended that the well be vertical. State regulatory agencies define a vertical well by permitting little drift from the vertical, typically up to about 3°. To be sure, deviated wells are intentionally drilled in many instances, but this is always done in accordance with special permits. It is also done is a more tedious fashion, typically being carried out with a directional tool and drilling motor. The more conventional fashion of drilling a well, even the straight portions of wells ultimately deviated, is all carried out by drilling vertically downwardly. Maximum rate of penetration is an important measure of the efficiency of the drilling process. If the process becomes slow, the time required for drilling increases, and the cost of the well ultimately increases. This is undesirable. With this straight hole drilling tool, the operator is able to maintain the weight on bit, hence, maintain a higher penetration rate.

The rate of drilling is improved some by drilling vertically. Moreover, the rate of drilling is improved by drilling with as true a vertical well as can be possibly accomplished. Generally, more weight on the bit increases the rate of penetration, ROP below. The ROP is reduced where the well drifts from the vertical and weight on bit is decreased. In part, this reduction results from scuffing of the drill string against the side of the previously drilled borehole. Scuffing occurs and sometimes becomes so extreme that the hole is distorted from a round hole. The typical rotary drill bit forms a round hole. After the round hole has been formed to any reasonable depth, deviated drilling therebelow may prompt the drill string to rub against the side wall and thereby scuff the side wall forming a non-round portion. This is known as a key seat. The key seat is an area of trouble. It absorbs the energy required for rotation of the drill bit. In addition, it also raises the risk of tool failure or differential pressure sticking. This may hold the drill string against the side wall so that it is impossible to proceed any further. When that occurs, remedial steps have to be undertaken. One of the remedial steps is pulling the drill string, and then drilling with a reamer, mud motor, or hole straightener tool to reduce deviation.

Deviation of the borehole from a vertical plumb line is inevitable because the rotation of the drill bit sets Up a gyroscopic precessional drift, and irregularities in the resistance of the formations drilled will also prompt some measure of curvature. (Many bits have offset cutters). Also, bits are made with eccentric cutters. Most do riot consider the dip of earth formations encountered by the drill bit. If, for instance, several strata are encountered which are alternately hard and soft strata and the formation has a dip to the east of 45°, there is a tendency of the drill bit to slide or skid as it encounters each soft/hard interface. There are other causes of drift. Ultimately, all of these occur notwithstanding the fact that the drill string is formed of metal tubular members which, on the surface, are quite straight.

A typical drill stem is formed by assembling (from the hit up) several drill collars for weight and then a string of drill pipe. The drill stem is technically the entire assembled system above the drill bit including the string of drill pipe and drill collars. The drill pipe is typically conventional wall drill pipe which is somewhat flexible. The flexibility ol the drill pipe comes into play when drilling several thousand feet. Drill collars are added between the drill string and the drill bit to stiffen the lower portion on the theory that the stiffness of the drill collars provides better directional tracking. Also, the drill collars raise the weight on the bit (WOB hereinafter). Whether tracking ultimately is true depends on a number of dynamically encountered conditions including formation dip, precessional drift bit walking and others factors. The stiffness of the drill collars is significantly greater than the stiffness of the individual pipe joints making up the drill string. Drill collars are a joint of pipe formed with an extra thick pipe wall so that weight on the bit and drill collar stiffness are significantly increased. In simple language, it is hard to bend a drill collar because it is extra thick. Generally, drill collars have a thick wall, and are round or cylindrical shape. To be sure, in about 1965, several patents were issued to Fred K. Fox and many others relating to externally grooved drill collars. Still, such pipe were generally axially symmetrical in the sense that the mass moment of inertia was kept centered. Shallow helical grooves, checker board flats and other flats formed on the exterior did not significantly change the mass moment of inertia from the center-line axial position. When rotated in the conventional manner, there is no unwanted vibration or other wobble induced by variations from a traditional cylindrical, smooth wall construction. With or without helical turns or other flow paths along the exterior, drill collars are generally constructed so that the mass moment of inertia is aligned with the centerline. In this disclosure, a drill collar is set forth where the center of mass and the mass moment of inertia are offset from the centerline axis. In other words, the device is eccentered so that certain desirable vibrations are set up in operation.

The drill collar of the present disclosure sets up a wobbling vibration in operation. As a practical matter, at typical drilling, rates the several drill collars will wobble about a defined centerline axis. If the drill stem is being rotated at 50 rpm or more in a well borehole that is precisely vertical without drift, some wobble will occur. Assume further that the drill bit drills a hole in excess of 9" diameter and that the drill stem is made up primarily of drill pipe with a diameter of 5". This defines an annular gap of about 2" on the exterior for the annular space between the drill pipe and the open hole. As the pipe string becomes longer, there is a tendency for the column of pipe to rotate at the required velocity with some wobble along the length of the column. Imperfections in the pipe string including non-round pipe, bent joints and the like will prompt some wobble or rotation from the centerline axis. This wobble will materially impact the entire column of pipe. To be sure, wobble is generally suppressed in the area where the drill collars are located because they are much stiffer and have a reduced tendency to wobble from the centerline axis of the drill stem. Even so, there is some modest amount which is so small as to be imperceptible in that region.

The present disclosure takes advantage of eccentering of the drill collar. More than that, it takes advantage of cutters which are attached at specified locations along the drill collar so that reaming of other narrow areas is accomplished thereby maintaining a straighter and more true borehole. Preferably, the drill collar of the present disclosure is conveniently formed of a square billet which is drilled through to define a drill collar. If perfectly square, it will provide a centered mass and a mass moment of inertia coincident with the centerline axis. In this particular instance, it is constructed of a square billet with three full gauge corners in the cross-sectional shape. The fourth corner is modified, i.e., it is removed. This provides an offset or eccentering of the mass moment of inertia and center of gravity. Moreover, this prompts the several drill collars connected in a string of drill pipe to create a region of wobble which extends beyond its normal location. If, for instance, the drill collar has a nominal diametric measure of 7", this wobble might effectively create a locus of movement which has a diameter of about 7.5". That enables an eccentered cutter to ream part of the borehole away and thereby making at more true borehole.

While the foregoing describes some benefits of the device, it is summarized as an eccentered drill collar formed of a square billet having three parallel square edges along the length thereof. The fourth edge is reduced so that the mass moment of inertia is eccentered to thereby induce controlled vibrations. Moreover, the controlled vibrations enable one or more cutters along the length to wobble into contact with the low sided borehole, thereby reaming the borehole to maintain or restore the borehole to reduce deviation of the well borehole. The borehole remains relatively true after being reamed through this drill collar equipped with cutters which cuts to a more true circle with ;i more true centerline axis free of drift.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIG. 1 shows a drill string in a well borehole and comprised of drill pipe above a drill collar so that controlled deviation is achieved during drilling to thereby provide straightening of the well borehole;

FIG. 2 is a perspective view of a drill collar in accordance with the present disclosure including three edges defined by a square cross-sectional area;

FIG. 3 is a sectional view along the line 3—3 of FIG. 2 showing one side of the drill collar omitted so the omission enables the drill collar to support described cutters for reaming the borehole; and FIGS. 4 and 5 shows how the rate of penetration is influenced by rpm and weight on bit utilizing the drill collar of the present disclosure.

DETAILED DESCRIPTION OF THE PREFERRED EMBODIMENT

Attention is first directed to FIG. 1 of the drawings which shows a well borehole 10 formed by a drill bit 12 which is operated in the conventional fashion. The typical equipment involved in drilling a well includes the drill bit 12 which is threaded to one or more drill collars 14. Above that, there are connected many joints of drill pipe which make up the drill string 16. There is a mechanical connection 18 between the drill string and the drilling rig 20. The drilling rig includes a power plant which is connected through suitable reducers to a rotary table which applies rotation to a Kelly threaded in the topmost joint of the drill string 16. Rotation from the surface imparts rotation to the drill hit. In theory the well borehole is circular and is vertical. The centerline axis should follow a plumb bob line in perfect circumstances. In actuality drift from the plumb line occurs in the manner previously mentioned.

From time to time, the drill string is drilled down to the point that another joint needs to be added. By this process, the borehole 10 is lengthened to the desired depth. Ultimately, when the drilling process is over, the well borehole can be perhaps 13,000' in depth, using a depth that is approximately equal to the average well drilled in the continental U.S.

The drill collar 14 shown in FIG. 1 in the drill stem is typically only one drill collar when the well is first initiated, but the number of drill collars is increased. Typically, drill collars are made in 30' lengths. matching the length of the drill pipe joints. Several are added in the drill stem. Assume, for purposes of description, that the di-ill stem is comprised of up to about 8 drill collars. They are relatively stiff and provide greater rigidity. They maintain the centerline position intended for them. They tend to be stiff sufficiently so that drilling is relatively straight. The present invention is an improvement over the conventional drill collar, namely, those which are thicker wall drill pipes with smooth or patterned external faces. As mentioned, helical grooves, checker boards and other flats deployed on the exterior have been known. Generally, the helical grooves and flats are some predefined pattern and they are evenly distributed around the circle, i.e., they do not detract from the centerline axis location of the mass of drill collars. The present disclosure features. however, a drill collar which intentionally departs from that construction. The drill collar of the present disclosure is identified at 24 in FIG. 2 of the drawings. Proceeding from the bottom, it has a smooth cylindrical portion 26 at one end which is sufficiently long to enable a set of tongs to grasp the drill collar. This portion is important in making and unmaking threaded joints. There is a portion at 28 where the drill collars fairs from a circular to a rectangular profile. More specifically, the cross-sectional representation of the drill collar 24 in FIG. 3 shows the device to be formed of square stock. The square stock 30 is square in all aspects except at one edge as will be defined. In FIG. 2 and in cross-section as shown in FIG. 3, there are diametric edges 32 and a third sharp edge 34. At the location of the fourth corner of the square, that corner has been rounded at 36 (see FIG. 3) and metal has been removed to offset the center of gravity and the mass moment of inertia as will be detailed. The radius of curvature at 36 reduces the weight, but does not thin the wall so that the drill collar becomes weak.

At the upper end, the drill collar is faired at 38 back to a circular shape. There is a circular neck 40 which is similar to the neck 26 incorporated for gripping by a set of tongs. The upper end shows the axial passage 42.

Going now specifically to FIG. 3 of the drawings, the radius of curvature 36 shows that metal has been removed. The numeral 44 identifies a scuff pad or button. The scuff pad is incorporated so that regions which contact the side of the borehole are protected against wear. Abrasion normally occurs with scuffing. The particular location of the scuff pad 44 is selected to insure that wobble of the drill collar as will be defined does not wear the collar. Moreover, the pads are included so that wobbling does not damage the drill collar.

A cutter 46 is affixed to one wall of the drill collar 24 as shown in cross section in FIG. 3. The cutter has an exposed sharp edge for reaming. The number and length of cutter components along the drill collar is such that reaming is done by contacting the borehole and cutting away a portion of the borehole. This reduces the narrow throat of any key seat region. In addition, it reshapes the serpentine path of the borehole (even where circular in cross-section) when the well borehole drifts as typically does happen. FIG. 3 additionally shows the centerline axis at 48. The center of gravity is offset at 50. This changes the mass moment of inertia. This changes the mode in which wobble arises during drilling, and changes the lateral extension of the cutter. Examples of vibration to the side will be given in conjunction with variations of the ROP as a function of rpm and weight on bit.

Consider the swing to the side resulting from rotation of the drill bit. Going to FIG. 1 of the drawings, the numeral 52 indicates a more or less conic locus of the drill stem including the drill collars as a result of vibrations which occur during rotation. Rotation imparted to a perfectly vertical drill stem which is dynamically balanced for rotation will nevertheless still set up a standing wave between the rotary table at the top and the drill bit at the bottom. This standing wave prompts lateral excursions which move the drill stem out toward the well borehole. With the exemplary 2" annular spacing given above, the rotation moves the drill stem to the dotted line position 52. There may be a single standing wave cycle or multiple cycles established simultaneously in the drill stem. Without regard to the particulars of the standing wave, this involves both the drill pipe and the drill collars 14. The drill collar 24, of the present disclosure, is installed above the drill bit. It can be only one drill collar, or it can be mixed with several conventional thick wall cylindrical drill collars. Whether alone or with others, the drill collar 24 is caused to wobble in the manner discussed. This inevitably brings the drill collar into scuffing contact with the borehole. The parallel square corners 32 and 34 are wobbled into contact with the borehole. Where scuffing occurs, the scuff plates 44 will prevent abrasion which damages the drill collar. More than that, the cutters 46 will ream the borehole so that improved clearance is provided.

The cutter 46 is preferably a flat tungsten carbide body which is brazed or otherwise joined along one face. It can be formed of tungsten carbide particles in a cobalt alloy matrix for hardness while yet being somewhat shock resistant. If desired, the cutting edge can be formed of tungsten carbide particles or it can be enhanced and protected with industrial grade diamonds (again, diamond particles in a supportive matrix of cobalt alloy) so that abrasion does not damage the cutter 46. As shown in FIG. 3, the cutter extends slightly beyond the edge or face. The amount or extent of this sharp edge is subject to variation. Realistically, it need only extend less than about 0.125". Preferably, an extension of about 0.0625" will suffice. The cutter has a finite thickness, typically being up to about 0.125" in thickness and has a blade width of about one inch or so.

The drill collar 24 has a nominal length of about 30'. If the cylindrical portions 26 to enable tong handling arc subtracted, this leaves about 24' in length which is formed of the square billet construction. The cutter 46 has the form of multiple blades which aggregate tip to about 25' in total length (see FIG. 2). Generally, that is excessive. It is therefore desirable that the aggregate cutting blade length for the single drill collar be less. It is permissible for the cutter 46 to have a total height of about one-half or less of the drill collar length. This reduces the cost of the drill collar without detracting from its ability to ream the borehole. The cutter 46 is deployed as several pieces. The several pieces in the aggregate add up to about 50% of the collar length. In other words, if the edge 32 has a length of 25', cutters are deployed along about one-half of that length.

The benefit of the reaming accomplished by the cutters on the drill collar 24 is achieved when the rotating pipe column swings out as indicated in the dotted line representation at 52 (see FIG. 1) This is beneficial as represented in FIGS. 4 and 5. Both are views showing the ROP as a function of different variables. For a given weight on bit in a selected formation, the ROP is increased as shown in FIG. 4. The curve 54 is representative of the performance without the drill collar 24 incorporated in the drill string. The curve 56 shows a comparative improvement using the drill collar 24. This improvement is a result of the reduction of scuffing and drag of the drill string caught in a key seat region of the well borehole 10. If the well is deviated, the scuffing may occur on the low side. The curve 56 has a apex at 58 which shows optimum performance, i.e. the ROP is increased for an optimum rpm for the drill bit. Attention is now directed to FIG. 5 which shows the ROP as a function of weight on the drill bit. The curve 60 represents a normal drill collar. In this particular instance, the weight on the drill bit in a drill string enhanced with the present apparatus provides improved ROP as shown by the curve 62. There is an apex 64 for a given set of conditions, i.e., wear of the drill bit, formation hardness and so on. Viewing FIGS. 4 and 5 together, it will be understood that improved performance (an increasing ROP) is obtained through the use of tile drill collar 24 of the present disclosure. In particular, this drill collar enables improved performance in key aspects when installed in the drill stem. Preferably, one or two units of the drill collar 24 are installed with up to about 25 conventional drill collars. Where up to about 20 drill collars are normally installed, it is sufficient that one or two of the large number of drill collars be equipped with the cutters described in FIGS. 2 and 3. The number of drill collars is often selected so that WOB is about 40,000 to 70,000 pounds.

One aspect of the operation is the gap between the centerline axis at 48 and the eccentered center of gravity 50, see FIG. 3. By utilizing this short distance, the drill stem is caused to vibrate slightly and wobble away from the centerline axis. Cutting occurs as the cutting edge 46 is brought against the borehole. As viewed in FIG. 3, the cutting, edge 46 is located for clockwise rotation, i.e, the conventional direction of rotation.

The drill collar edge 34 may scuff against the borehole 10. If so, the cutting edge 46 can be duplicated at that location also. If duplicated, the cutting edge 46 is installed so that it also cuts against the borehole. The depth of cut by the cutter 46 is relatively shallow, i.e. it protrudes only slightly along the edge of the square billet. Since the edge is brought into contact with the well borehole 10 as many as one hundred times per minute, a deep cut is not needed. Since cutting occurs in the annular space where the mud flow return to the surface occurs, all the cuttings are carried back to the surface.

While the foregoing has been directed to the preferred embodiments, the scope is determined by the claims which follow.

I claim:

1. A drill collar comprising an elongate hollow tubular member having an internal bore for delivery of drilling fluid through said drill collar, and having an external profile having a flat surface, and having a cutting edge formed on an edge of a planar blade wherein a planar surface of said blade is attached to said flat surface at a selected location along the length of said drill collar, and wherein the mass of the drill collar is eccentered.

2. The drill collar of claim 1 wherein said cutting edge is parallel to a centerline axis of said internal bore.

3. The drill collar of claim 1 wherein the drill collar is, in cross section, formed with a square cross section and one corner is truncated.

4. A drill collar comprising:

(a) an elongate hollow tubular member having an internal bore for delivery of drilling fluid through said drill collar; and (b) an external profile having a cutting edge therealong at a selected location along the length of said drill collar, wherein (i) the mass of the drill collar is eccentered, (ii) said hollow tubular member comprises at least a pair of lengthwise planar faces defining an edge therealong, and (iii) said cutting edge is formed on a blade mounted to extend beyond said edge.

5. The drill collar of claim 4 wherein said planar faces are at a right angle and said blade is mounted on one of said planar faces.

6. The drill collar of claim 5 wherein said blade is tungsten carbide particles in an alloy matrix having an exposed cutting edge, and said blade is replicated along the drill collar.

7. The drill collar of claim 6 wherein said blade secured to said drill collar by brazing.

8. The drill collar of claim 7 wherein said drill collar is protected by scuff pads on the planar faces.

9. The drill collar of claim 4 wherein the drill collar is, in cross section, formed with a square cross section and one corner is truncated, and wherein the square cross section defines three full gauge corners.

10. A drill collar comprising:

(a) two elongate hollow cylindrical end portions having threaded connections at the ends thereof;

(b) at least one flat surface and at least two corners in cross section;

(c) a planar cutting member with a planar surface which is attached to said flat surface so that said cutting member extends outwardly for reaming during rotation; and wherein (d) the mass of said drill collar is eccentered for vibration during rotation.

11. The drill collar of claim 10 wherein said drill collar is formed from a square billet and has at least two sharp edges defined by three said flat surfaces comprising planar faces at right angles; and said planar cutting member is defined by a blade attached to one of said planar faces and has a cutting edge protruding beyond said sharp edges.

12. The drill collar of claim 11 wherein said cutting edge protrudes beyond said sharp edges up to about 0.125 inches.

13. A drill collar comprising two elongate hollow cylindrical end portions having threaded connections at the ends thereof, and wherein (a) said drill collar, in cross-section, comprises at least two corners and a cutting member extends outwardly for reaming during rotation;

(b) the mass of said drill collar is eccentered for vibration during rotation;

(c) said drill collar is formed from a square billet and has at least two sharp edges defined by three planar faces at right angles;

(d) said cutting member is defined by a blade attached to said drill collar and has a cutting edge protruding beyond said sharp edges; and (e) said square billet has four planar faces at right angles, and said faces define three sharp edges at right angles, and said drill collar is constructed so that the fourth edge is omitted.

14. The drill collar of claim 13 wherein said planer faces, at the location of the fourth edge, fair into a curvature so that said fourth edge is omitted.

15. The drill collar of claim 14 wherein said square billet shape extends to said cylindrical end portions to define tong engaging surfaces.

16. The drill collar of claim 14 wherein omission of the fourth edge eccenters said drill collar.

17. The drill collar of claim 14 wherein:

(a) said drill collar has a circular opening therein; and (b) said circular opening extends axially therethrough to said end portions of said drill collar.

18. The drill collar of claim 17 wherein said circular opening extending axially through said billet drill collar walls which are thicker in construction than connected drill pipe.

19. The drill collar of claim 18 wherein said planar faces provide mounting surfaces for said blade, and said blade is replicated along said drill collar to define a desired cutting edge.

20. The drill collar of claim 19 wherein said blade is mounted to protrude up to about 0.125 inches.

* * * * *